US006829846B2

(12) United States Patent
Cagliari et al.

(10) Patent No.: US 6,829,846 B2
(45) Date of Patent: Dec. 14, 2004

(54) SPORTS BOOT INCLUDING A RIVETED AND ADHESIVELY-BONDED FLAP

(75) Inventors: Peter Cagliari, Montebelluna (IT); Riccardo Perotto, Venegazzu (IT)

(73) Assignee: Lange International S.A., Fribourg (CH)

( * ) Notice: Subject to any disclaimer, the term of this patent is extended or adjusted under 35 U.S.C. 154(b) by 0 days.

(21) Appl. No.: 10/439,826

(22) Filed: May 16, 2003

(65) Prior Publication Data

US 2003/0217486 A1 Nov. 27, 2003

(30) Foreign Application Priority Data

May 22, 2002 (CH) ..... 0852/02

(51) Int. Cl.[7] ..... A43B 5/04
(52) U.S. Cl. ..... 36/50.5; 36/117.1; 36/118.2
(58) Field of Search ..... 36/50.5, 117.1, 36/118.2

(56) References Cited

U.S. PATENT DOCUMENTS 3,721,023 A * 3/1973 Kastinger ..... 36/118.2
4,508,582 A * 4/1985 Fink ..... 36/45
5,251,388 A * 10/1993 Pozzobon et al. ..... 36/50.5
5,365,679 A * 11/1994 Chemello ..... 36/117.7
5,426,872 A * 6/1995 Hayes ..... 36/118.9
5,553,401 A * 9/1996 Wittmann et al. ..... 36/117.6
5,611,154 A * 3/1997 Lucchetta et al. ..... 36/50.5
5,649,375 A * 7/1997 Zorzi ..... 36/117.1
5,718,065 A * 2/1998 Locker ..... 36/117.1

FOREIGN PATENT DOCUMENTS

EP 659359 * 6/1995
EP 1066767 * 1/2001

* cited by examiner

*Primary Examiner*—Ted Kavanaugh
(74) *Attorney, Agent, or Firm*—Bugnion S.A.; John Moetteli

(57) ABSTRACT

A sports boot made up of an upper having first and second elements assembled by bonding and use of a mechanical device. A part of one of the elements permanently covers the mechanical device in order to seal it and to hide the mechanical device from view, in order to create a more visually appealing boot.

12 Claims, 3 Drawing Sheets

SPORTS BOOT INCLUDING A RIVETED AND ADHESIVELY-BONDED FLAP

BACKGROUND OF THE INVENTION

The present invention relates to the field of sports boots. It relates in particular to a sports boot, the upper of which comprises two elements assembled by adhesive bonding and a mechanical means or by adhesive bonding and stitching.

PRIOR ART

In order to produce increasingly comfortable ski boots, to make them use is made of materials with different characteristics, particularly different stiffness characteristics. This therefore poses the problem of assembling these elements that consist of different materials. To produce certain boots, bi-injection-moulding processes are employed, which makes it possible to construct shells with zones of different stiffness.

Furthermore, U.S. Pat. No. 3,483,638, the content of which is incorporated by reference, discloses a process for manufacturing ski boots in which two flaps arranged over the top of the upper partially cover over one another and have buckles and tensioning devices, respectively. The manufacturing process consists in the boot vamp being open, in the buckles and tensioning devices being, respectively, fastened over each of the flaps, and then in the flaps, which are preferably made from an elastic plastics material, being attached to the edges of the vamp by stitching, for example.

U.S. Pat. No. 6,148,546, the content of which is incorporated by reference, discloses a sports boot that includes a sole from which an upper that covers the foot extends. The upper is composed of two parts. The first part is produced in a relatively rigid material, constituting a cradle forming a rear casing for housing the user's heel and in a single piece with the sole in the heel zone. The second part of the upper is produced in a relatively flexible material, constituting a band for covering over the front of the user's foot and for attaching securely to the front part of the sole on the one hand and to the edges of the rear casing. The patent describes, as linking means between the band and the sole, rivets, adhesive bonding, welding or, alternatively, stitching.

However, these processes present drawbacks in that the assembly methods that use adhesive bonding are relatively poorly resistant to mechanical stresses. They are particularly sensitive when the adhesive-bonding joint undergoes peeling stresses, i.e. when tensile stresses are applied to it. Assembly methods using rivets are not watertight and are unattractive. Assembly methods using welding and assembly methods using stitching cannot be applied to all the materials. Assembly methods using stitching are neither attractive nor watertight.

SUMMARY OF THE INVENTION

The object of the invention is to produce a sports boot that has an assembly that mitigates these drawbacks. In particular, the invention proposes producing a boot that has two elements linked by a strong, leaktight, and attractive assembly method. The assembly method must also allow the linking of materials of different types.

The sports boot according to the invention is noteworthy in that a part of one of the elements of the upper permanently covers over the assembly.

According to one embodiment, one of the elements covers over the assembly by folding over on itself.

In this case, the element covering over the assembly may be adhesively bonded onto itself.

The assembly process that makes it possible to obtain such a boot is noteworthy in that it comprises the stages:

assembling the two elements by adhesive bonding and a mechanical means or by adhesive bonding and stitching;

folding one of the elements over itself in order to cover over the assembly.

According to one embodiment, a lip on the first element covers over the assembly and is adhesively bonded onto the second element.

The assembly process that makes it possible to obtain such a boot is noteworthy in that it comprises the following stages:

assembling the two elements by a mechanical means or by stitching;

covering over the assembly with a lip on the first element;

adhesively bonding the lip to the second element.

According to the embodiments, the two elements are a shell and a flap.

According to the embodiments, the first element is a shell and the second is a flap.

According to the embodiments, the first element is a flap and the second is a shell.

BRIEF DESCRIPTION OF THE DRAWINGS

The appended drawing shows, by way of example, three embodiments of a boot according to the invention.

DESCRIPTION OF THE PREFERRED EMBODIMENTS

Figure 1:
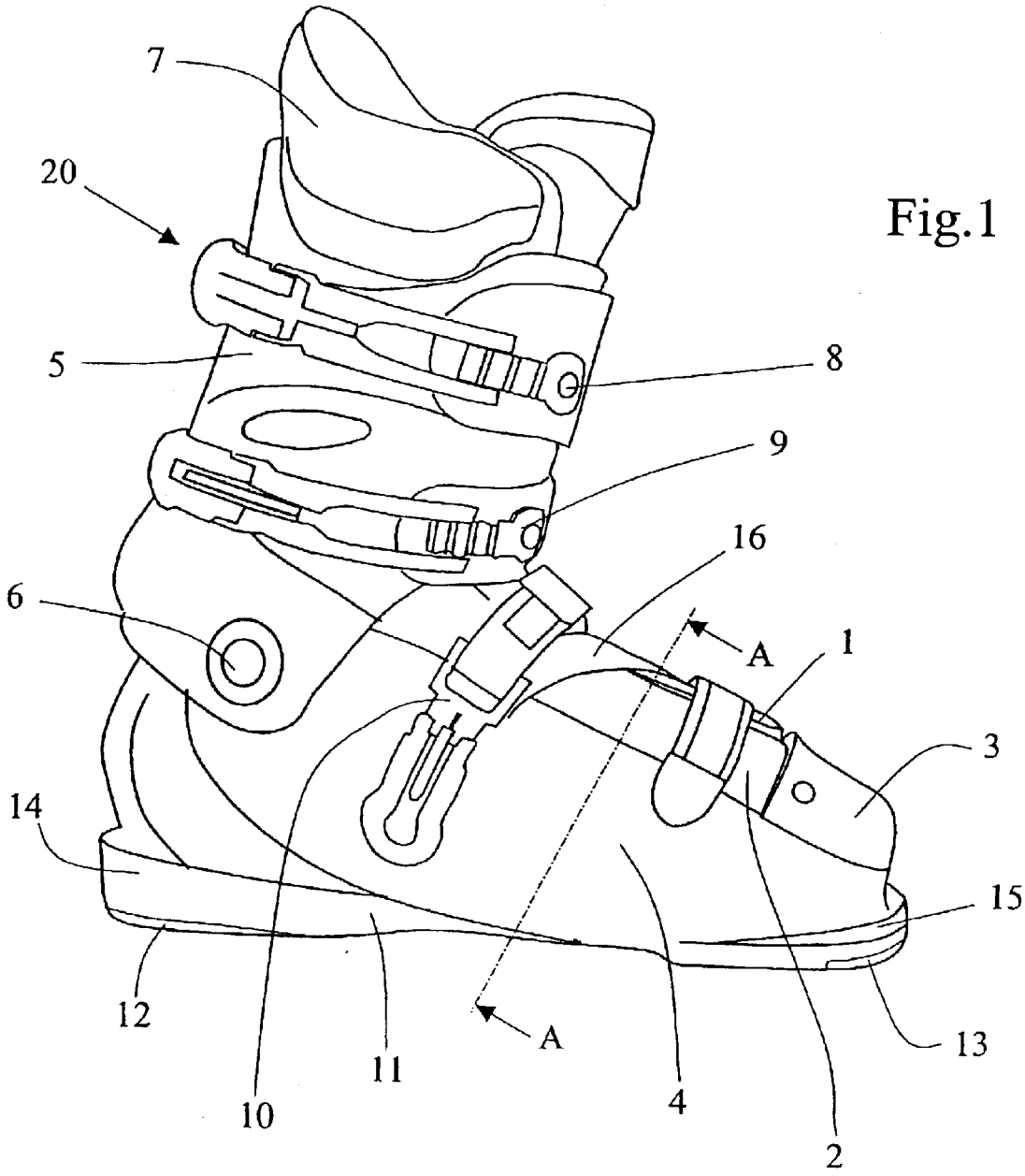
FIG. 1 is a side view of a ski boot that has a shell equipped with flexible flaps on the top of the upper.

The ski boot 20 shown in FIG. 1 consists essentially of a shell 4, a collar 5 articulated on the shell 4 in the ankle region at a point 6 and at an opposite point located on the other side of the boot 20. This shell 4 and this collar 5 receive a comfort liner 7. The shell 4, preferably made from polyurethane, constitutes a cradle for the comfort liner 7. This shell 4 comprises a sole 11 that has a rear curb 14 and a front curb 15. The sole 11 is equipped, in a known manner, with a heel plate 12 and a front plate 13, both produced from hard rubber. The collar 5 is equipped with two buckles 8 and 9, and the shell 4 with a buckle 10 that comprises a strap 16 in the shape of a Z. The upper zone of the shell extending from the instep to the toes consists of two flaps 1 and 2 produced from a flexible material, such as leather.

Figure 2:
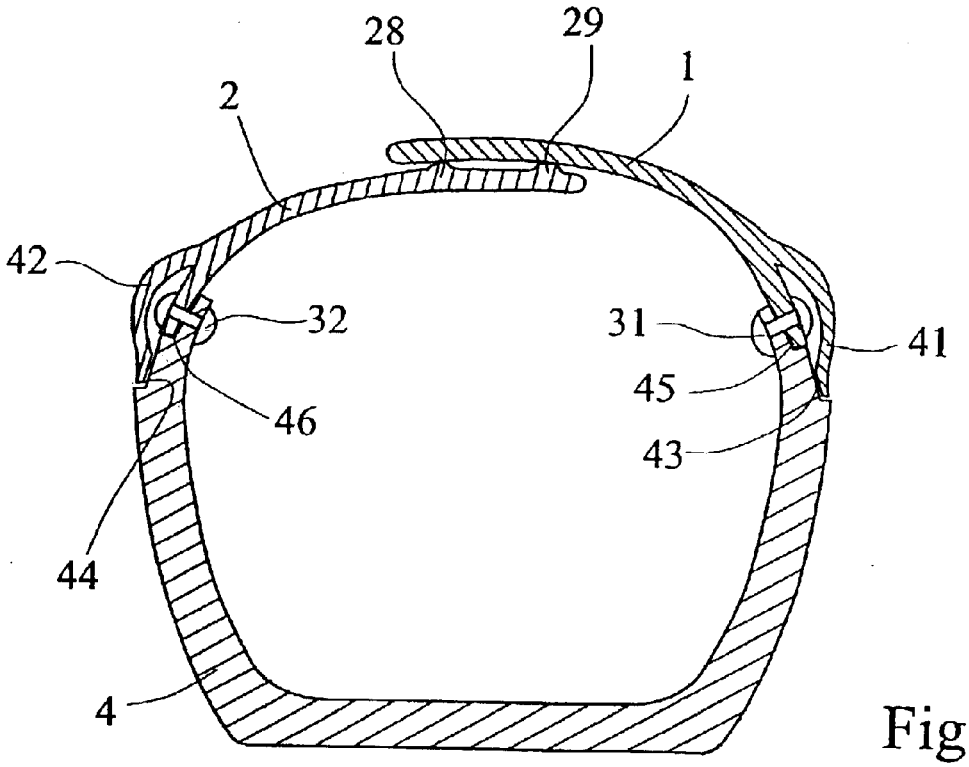
FIG. 2 is a section on the plane A—A in the front part of a boot with flaps produced according to a first embodiment.
Figure 3:
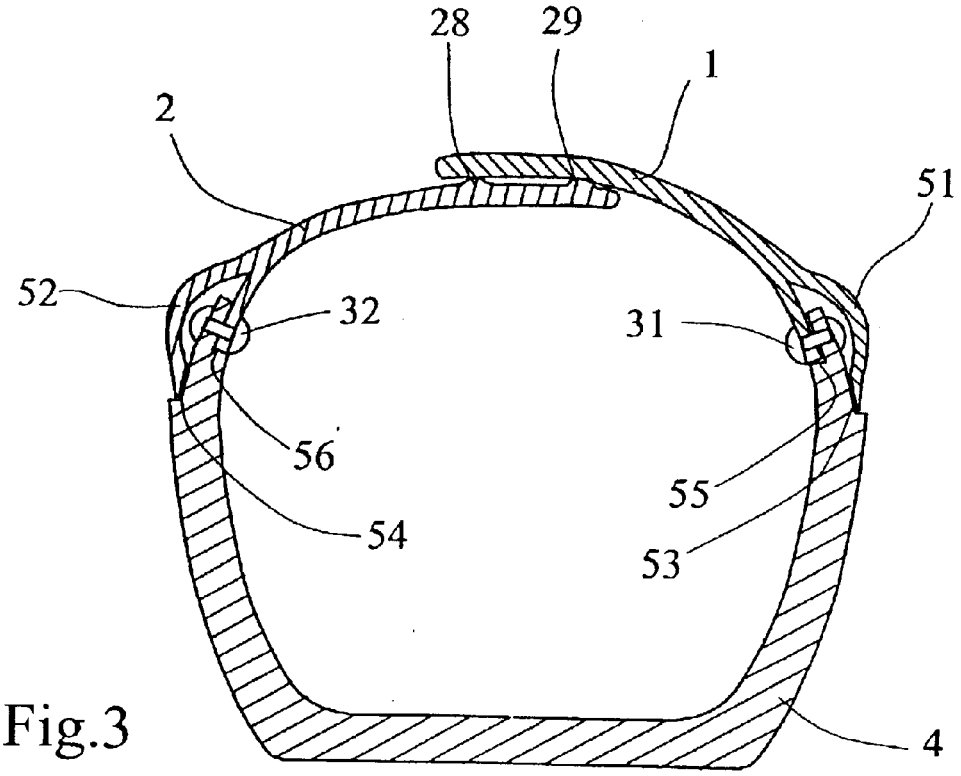
FIG. 3 is a section on plane A—A in the front part of a boot with flaps produced according to a variant of the first embodiment.
Figure 4:
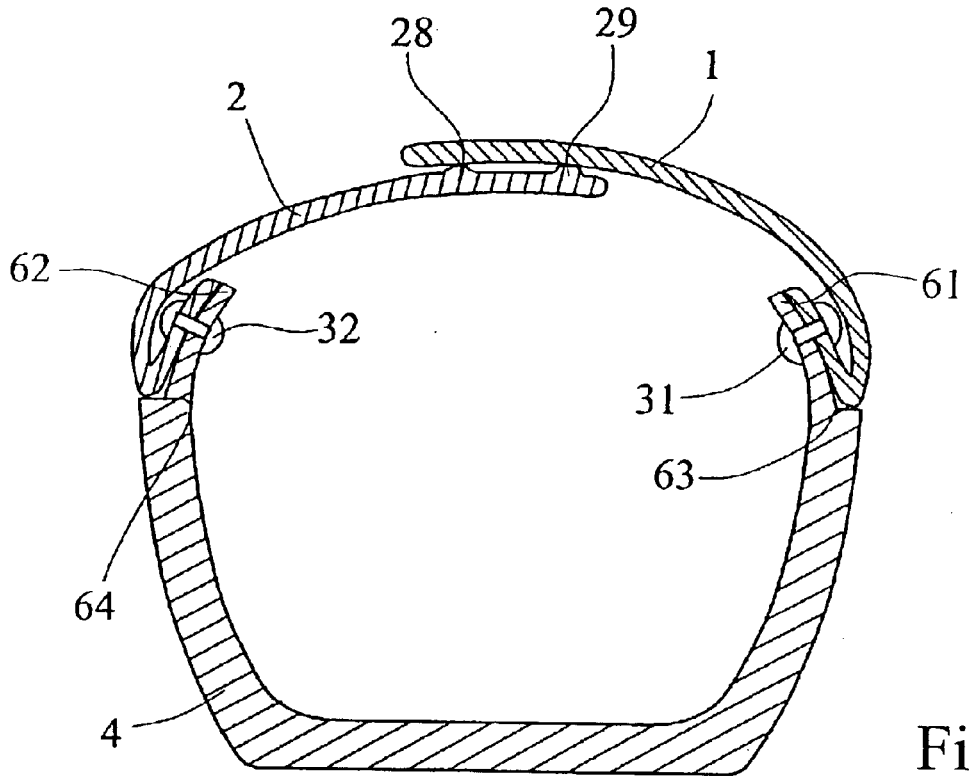
FIG. 4 is a section on plane A—A in the front part of a boot with flaps produced according to a second embodiment.

As shown in FIGS. 2 to 4, these two flaps 1 and 2 partially cover one another over. The flap 2 has, on its outer face, a first beading 29 extending continuously along the flap 2, approximately following the contour of the edge of the flap 2, and a second beading 28 distant from the beading 29 but arranged so as to be covered over by the flap 1 when the boot 20 is closed. Watertightness is guaranteed by the deformations of the beadings 28, 29 and of the flaps 1, 2 that make it possible, between these elements, to form continuous contact curves when the buckle 10 is fastened. The flaps 1 and 2 are covered in the front part of the boot 20 with a cap 3 that enhances watertightness. The front part of the flap 1 is partially covered over by the cap 3 and the front part of the flap 2 is completely covered over by the cap 3. The flaps 1 and 2 are fastened onto the shell 4 by rivets 31, 32. The watertightness of the assembly is guaranteed by adhesive bonding of the flaps 1 and 2 onto the shell 4.

The section in plane A—A in the front part of a ski boot produced according to a first embodiment is shown in FIG. 2. The comfort liner is not shown in this view. In order to produce such a boot, the edge of the flap 2 equipped with a lip 42 is arranged on a shoulder 46 formed on the outside of the shell 4. The flap 2 is assembled onto the shell 4 using rivets 32. The rivets 32 are put in place from the outside of the boot, the lip 42 of the flap 2 being raised in order to allow the passage of the rivets 32 and of the head of a riveting tool. The lip 42 is then folded down over the assembly and its end is adhesively bonded onto a shoulder 44 produced on the outside of the shell 4.

The flap 1 is then assembled onto the shell 4. The edge of the flap 1 equipped with a lip 41 is arranged on a shoulder 45 formed on the outside of the shell 4. The flap 1 is assembled onto the shell 4 using rivets 31. The rivets 31 are put in place from the outside of the boot, the lip 41 of the flap 1 being raised in order to allow the passage of the rivets 31 and of the head of a riveting tool. The lip 41 is then folded over the assembly and its end is adhesively bonded onto a shoulder 43 formed on the outside of the shell 4 so as to permanently cover over the rivets 31. This obtains an assembly that offers good mechanical strength, is watertight, and is attractive.

The section in plane A—A in the front part of a ski boot produced according to a variant of the first embodiment is shown in FIG. 3. The comfort liner is not shown in this view. In order to produce such a variant, the edge of the flap 2 equipped with a lip 52 is arranged on a shoulder 56 formed on the inside of the shell 4. The flap 2 is assembled onto the shell 4 using rivets 32.

The rivets 32 are put in place from the outside of the boot, the lip 52 of the flap 2 being raised in order to allow the passage of the rivets 32 and of the head of a riveting tool. The lip 52 is then folded down over the assembly and its end is adhesively bonded onto a shoulder 54 formed on the outside of the shell 4. The flap 1 is then assembled onto the shell 4. The edge of the flap 1 equipped with a lip 51 is arranged over a shoulder 55 formed on the inside of the shell 4. The flap 1 is assembled onto the shell 4 using rivets 31. The rivets 31 are put in place from the outside of the boot, the lip 51 of the flap 1 being raised in order to allow the passage of the rivets 31 and the head of a riveting tool. The lip 51 is then folded down over the assembly and its end is adhesively bonded over a shoulder 53 formed on the outside of the shell 4.

The section in plane A—A in the front part of a ski boot produced according to a second embodiment is shown in FIG. 4. The comfort liner is not shown in this view. The end of the flap 2 is fastened by rivets 32 on a shoulder 64 of the shell 4. To do this, the flap 2 is folded out and allows the passage of the rivets 32 and the passage of the head of a riveting tool. The flap 2 is simultaneously adhesively bonded over the part 62 of the shell 4, bonding adhesive having previously been arranged on the part 62 of the shell 4 and over the zone of the flap 2 that is designed to come into contact with this part 62. The flap 2 is then folded over on itself so as to conceal the rivets 32. The flap 1 is then assembled onto the shell 4. The end of the flap 1 is fastened by rivets 31 on a shoulder 63 of the shell 4. To do this, the flap 1 is folded out and allows the passage of the rivets 31 and the passage of the head of a riveting tool. The flap 1 is simultaneously adhesively bonded over the part 61 of the shell 4, bonding adhesive having previously been arranged on the part 61 of the shell 4 and over the zone of the flap 1 that is designed to come into contact with this part 61. The flap 1 is then folded over on itself so as to conceal the rivets 31. This obtains an assembly that offers good mechanical strength, is watertight, and is attractive.

It should be noted that, after having been folded over on themselves, the flaps 1, 2 may be adhesively bonded onto themselves in order to prevent them folding out.

Figure 5:
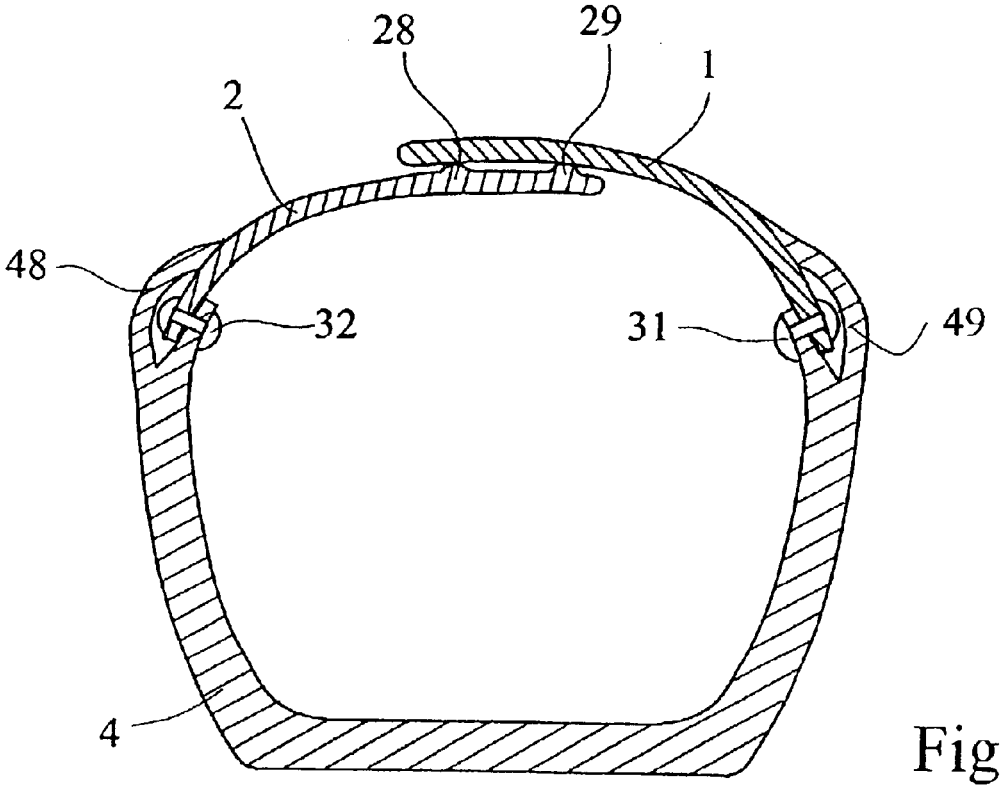
FIG. 5 is a section on plane A—A in the front part of a boot with flaps produced according to a third embodiment.

A section through the boot according to a third embodiment is shown in FIG. 5. This embodiment differs from the first embodiment in that the lips 48, 49 consist of flexible parts of the shell 4 covering over the assembly and adhesively bonding to the flaps 1, 2.

In all the above embodiments, use is made of rivets to assemble the flaps onto the shell. Nevertheless, these rivets may be replaced by other mechanical means, such as staples or even by stitching. These means depend in particular on the materials used to produce the two elements to be assembled.

Although illustrative embodiments of the invention have been shown and described, a wide range of modification, change and substitution is contemplated in the foregoing disclosure and in some instances, some features of the present invention may be employed without a corresponding use of the other features. Accordingly, it is appropriate that the appended claims be construed broadly and in a manner consistent with the scope of the invention.

What is claimed:

1. A sports boot comprising an upper made up of first and second elements assembled by bonding and use of a mechanical fastening device, wherein a part of one of the elements permanently covers the mechanical fastening device.

2. The sports boot as claimed in claim 1, wherein one of the elements extends over the assembly means by folding over on itself.

3. The sports boot as claimed in claim 2, wherein the element covering the assembly means is adhesively bonded onto itself.

4. The assembly process for obtaining a boot as claimed in claim 3, which comprises the following stages:

assembling the two elements by a mechanical means or by stitching;

covering the assembly means with a lip on the first element;

adhesively bonding the lip to the second element.

5. The sports boot as claimed in claim 2, wherein the part covering the mechanical fastening device is adhesively bonded to itself.

6. The sports boot as claimed in claim 1, wherein the part has a lip which covers the mechanical fastening device and wherein the bonding bonds the lip to the other element.

7. The sports boot as claimed in one of the preceding claims, wherein the two elements are a shell and a flap.

8. The sports boot as claimed in claim 7, wherein the first element is a shell and the second is a flap.

9. The sports boot as claimed in claim 7, wherein the first element is a flap and the second is a shell.

10. An assembly process for obtaining a boot as claimed in claim 2, which comprises the stages:

assembling the two elements by adhesive bonding and a mechanical means or by adhesive bonding and stitching;

folding one of the elements over itself in order to cover the assembly means.

11. The sports boot as claimed in claim 1, wherein the mechanical device is selected from a group of mechanical devices consisting of rivets, staples, and stitches.

12. The sports boot as claimed in claim 1, wherein the part of one of the elements which extends over the mechanical fastening device folds against the element of which it is a part.

* * * * *